US011884450B2

(12) United States Patent
Kabe et al.

(10) Patent No.: US 11,884,450 B2
(45) Date of Patent: Jan. 30, 2024

(54) PALLET FOR PACKAGING LOAD OBJECT

(71) Applicant: FUJIFILM Business Innovation Corp., Tokyo (JP)

(72) Inventors: Yusuke Kabe, Kanagawa (JP); Naoto Chiba, Kanagawa (JP); Takaaki Yoshida, Kanagawa (JP); Seiya Imai, Kanagawa (JP); Misaki Suruga, Kanagawa (JP); Koichi Tabira, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 7 days.

(21) Appl. No.: 17/535,678

(22) Filed: Nov. 25, 2021

(65) Prior Publication Data

US 2023/0027778 A1 Jan. 26, 2023

(30) Foreign Application Priority Data

Jul. 20, 2021 (JP) ..... 2021-119207

(51) Int. Cl.
*B65D 19/00* (2006.01)

(52) U.S. Cl.
CPC ..... *B65D 19/0026* (2013.01); *B65D 2519/00273* (2013.01); *B65D 2519/00288* (2013.01); *B65D 2519/00333* (2013.01); *B65D 2519/00373* (2013.01)

(58) Field of Classification Search
CPC ..... B65D 2519/00373; B65D 2519/00333; B65D 2519/00288; B65D 2519/00273; B65D 19/0026
USPC ..... 108/57.33, 51.3, 51.11, 53.3
See application file for complete search history.

(56) References Cited

U.S. PATENT DOCUMENTS 2,479,728 A * 8/1949 Darling ..... B65D 19/0028 108/57.1
4,424,753 A * 1/1984 Eatherton ..... B65D 19/0012 428/184
4,790,249 A * 12/1988 Webb ..... B65D 19/0012 428/116
4,936,229 A * 6/1990 Parnell ..... B65D 19/0012 108/51.3
5,129,329 A * 7/1992 Clasen ..... B65D 19/0012 108/52.1

(Continued)

FOREIGN PATENT DOCUMENTS

JP H07507029 8/1995
JP 2019034780 3/2019

(Continued)

*Primary Examiner* — Jose V Chen
(74) *Attorney, Agent, or Firm* — JCIPRNET

(57) ABSTRACT

A pallet includes: a top plate that has a rectangular shape and that is to be loaded with a load object; multiple blocks that are disposed at a multiple locations including four corners of the top plate and that support the top plate from below; and a bottom plate that is disposed such that the multiple blocks are placed on the bottom plate. The top plate has a long side and a short side. Blocks included in the multiple blocks and disposed at the corners of the top plate each has a long side and a short side. The long side of each of the blocks included in the multiple blocks and disposed at the corners of the top plate is disposed along the short side of the top plate.

8 Claims, 6 Drawing Sheets

(56) References Cited

U.S. PATENT DOCUMENTS 5,156,094 A * 10/1992 Johansson ..... B65D 19/0028 108/51.3
5,370,062 A * 12/1994 Johnston ..... B65D 19/0026 108/51.3
5,372,074 A 12/1994 Kilpatrick et al.
5,388,531 A * 2/1995 Crews ..... B65D 19/0012 108/56.3
5,413,054 A * 5/1995 Collins ..... B65D 19/44 108/55.3
5,487,344 A * 1/1996 Hutchison ..... B65D 19/0073 108/56.1
5,672,412 A * 9/1997 Phares ..... B32B 3/266 428/184
5,887,529 A * 3/1999 John ..... B65D 19/0018 108/57.33
6,332,535 B1 * 12/2001 Usui ..... B65D 71/0096 206/386
7,219,609 B1 * 5/2007 Utz ..... B65D 19/44 108/55.3
10,710,768 B2 7/2020 Tsukada et al.
2005/0145143 A1 * 7/2005 Moore, Jr. ..... B65D 19/0012 108/51.3
2006/0005746 A1 * 1/2006 Gouldin, Jr. ..... B65D 19/0091 108/51.11
2007/0283856 A1 * 12/2007 Berghmans ..... B32B 5/20 108/56.3
2013/0152832 A1 * 6/2013 Storteboom ..... B65D 19/40 29/469
2013/0174762 A1 * 7/2013 Hedley ..... B65D 19/40 108/57.33
2013/0274387 A1 * 10/2013 Zwick ..... C08J 3/226 524/145
2014/0069305 A1 * 3/2014 Luis y Prado ..... B65D 19/0012 108/51.11
2014/0174327 A1 * 6/2014 Whiteford ..... B65D 19/0095 108/57.33
2019/0061997 A1 * 2/2019 Behrens ..... B65D 77/061

FOREIGN PATENT DOCUMENTS

WO WO-9114631 A2 * 10/1991
WO 9323299 11/1993

* cited by examiner

PALLET FOR PACKAGING LOAD OBJECT

CROSS-REFERENCE TO RELATED APPLICATIONS

This application is based on and claims priority under 35 USC 119 from Japanese Patent Application No. 2021-119207 filed Jul. 20, 2021.

BACKGROUND

(i) Technical Field

The present disclosure relates to pallets.

(ii) Related Art

When a heavy product is to be transported, the product is loaded onto a wooden pallet and is transported together with the pallet by using a forklift or a pallet jack.

For example, Japanese Unexamined Patent Application Publication No. 2019-34780 proposes a pallet having stringer beams and designed to alleviate a vertical impact acting on the top plate of the pallet.

Japanese Translation of PCT Application Publication No. 7-507029 discloses a paper pallet with beams each having a cross-sectional shape with a wide upper surface and a narrow lower surface.

SUMMARY

In recent years, it is demanded that packaging materials be minimized and that packaging boxes and pallets be reduced in size for achieving higher loading efficiency and cost reduction. When a packaging box or a pallet is reduced in size, supporters, such as casters, supporting a product are placed directly above blocks that support the top plate of the pallet, thus making it difficult to absorb a transit impact and possibly damaging the product. Furthermore, if the blocks are to be made smaller for size reduction, there may be concerns about load shifting due to a reduced load bearing amount of the blocks, possibly making it difficult to achieve stacking.

Aspects of non-limiting embodiments of the present disclosure relate to a pallet having improved functions, as compared with a pallet that is simply reduced in size.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a pallet including: a top plate that has a rectangular shape and that is to be loaded with a load object; a plurality of blocks that are disposed at a plurality of locations including four corners of the top plate and that support the top plate from below; and a bottom plate that is disposed such that the plurality of blocks are placed on the bottom plate, wherein the top plate has a long side and a short side, wherein blocks included in the plurality of blocks and disposed at the corners of the top plate each has a long side and a short side, and wherein the long side of each of the blocks included in the plurality of blocks and disposed at the corners of the top plate is disposed along the short side of the top plate.

BRIEF DESCRIPTION OF THE DRAWINGS

An exemplary embodiment of the present disclosure will be described in detail based on the following figures, wherein.

DETAILED DESCRIPTION

An exemplary embodiment of the disclosure will be described below.

Figure 1A:
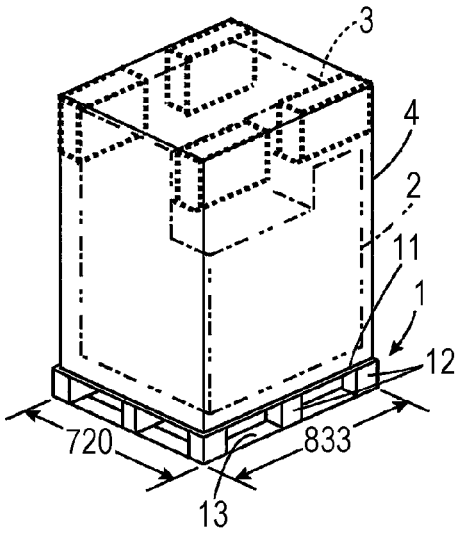
FIGS. 1A and 1B illustrate the background leading to an exemplary embodiment of the disclosure.
Figure 1B:
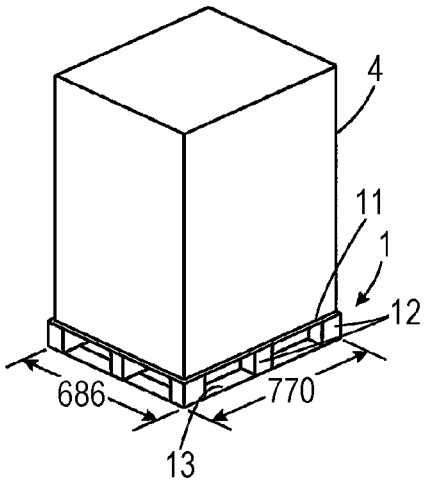

FIGS. 1A and 1B illustrate the background leading to an exemplary embodiment of the disclosure.

FIG. 1A illustrates a comparative example to be compared with the exemplary embodiment to be described later. In FIG. 1A, a product 2 indicated with a single-dot chain line is placed on a wooden pallet 1. Casters 21 (see FIGS. 2A and 2B) are attached to four lower corners of the product 2, and the casters 21 are placed directly on the pallet 1. Cushioning members 3 composed of, for example, foamed styrene are disposed around the product 2, and the product 2 and the cushioning members 3 are covered with a packaging box 4. Because the cushioning members 3 are disposed in the case of FIG. 1A, the packaging box 4 is large enough to accommodate the cushioning members 3 in addition to the product 2. Accordingly, the pallet 1 is large enough to place the large packaging box 4 thereon. In the example illustrated in FIG. 1A, the pallet 1 used is 833 mm by 720 mm. The pallet 1 includes a rectangular top plate 11 extending over the entire surface of the pallet 1, blocks 12 that support the top plate 11 from below, and a bottom plate 13 disposed such that the blocks 12 are placed thereon. The blocks 12 are disposed at multiple locations including the four corners of the rectangular top plate 11.

In recent years, size reduction of packaging materials has been studied.

FIG. 1B illustrates an image of size reduction.

FIG. 1B illustrates the packaging box 4 smaller in size compared to that in FIG. 1A, and the pallet 1 having the packaging box 4 placed thereon. As compared with the packaging box 4 illustrated in FIG. 1A, the packaging box 4 illustrated in FIG. 1B does not have the cushioning members 3 and only accommodates the product 2. Accordingly, the pallet 1 is also reduced in size. In the example illustrated in FIG. 1B, the pallet 1 is 770 mm by 686 mm.

However, simple size reduction of the pallet 1 may be insufficient and may lead to several problems.

Figure 2A:
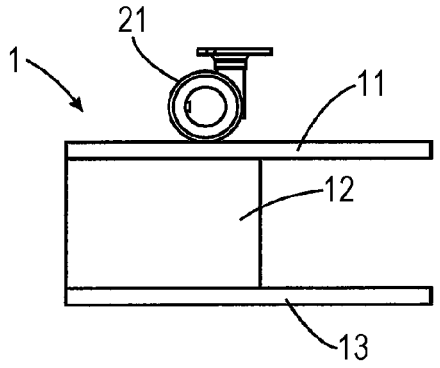
FIGS. 2A and 2B illustrate one of size-reduction-related problems.
Figure 2B:
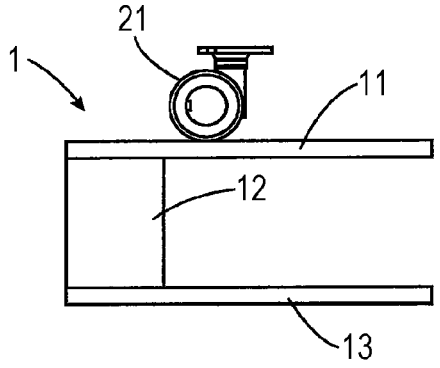

FIGS. 2A and 2B illustrate one of the size-reduction-related problems.

FIG. 2A illustrates an image where a pallet is simply reduced in size. When the packaging box 4 is reduced in size by eliminating the cushioning members 3 (see FIG. 1A) or the packaging box 4 itself is omitted, the pallet 1 on which the product 2 is to be placed may also be reduced in size. However, since size reduction of the pallet 1 does not necessarily lead to size reduction of the product 2, the casters 21 attached to the product 2 are to be placed closer to the corners of the pallet 1. Therefore, when the pallet 1 is simply reduced in size, the casters 21 of the product 2 may possibly be placed at positions overlapping or close to the blocks 12 of the pallet 1, as illustrated in FIG. 2A.

The pallet 1 utilizes the bending of the top plate 11 to absorb a transit impact by allowing the casters 21 to be placed on the top plate 11 at positions not overlapping the blocks 12. Thus, when any of the casters 21 is placed at a position overlapping any of the blocks 12, as illustrated in FIG. 2A, the transit impact is directly transmitted to the product 2, possibly impairing the adjustment of the product 2 or damaging the product 2.

Figure 5A:
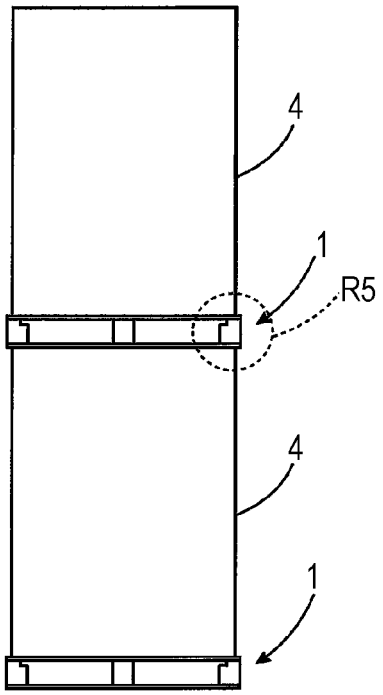
FIG. 5A and FIG. 5B are a front view and a partially enlarged view, respectively, illustrating two stacked pallets loaded with products, as viewed from a long side of a top plate.

FIG. 2B illustrates an image where the pallet 1 is reduced in size and the blocks 12 are further reduced in size for preventing the casters 21 from being placed at positions overlapping the blocks 12. Even in this case, vibrations are absorbed by the bending of the top plate 11 in view of vertical vibrations alone. However, when the blocks 12 are small in size, the blocks 12 may tilt and cause the top plate 11 to slide sideways relative to the bottom plate 13 when a horizontal force is applied to the top plate 11, possibly causing the pallet 1 to break. When products 2 are piled by stacking pallets 1 vertically, as illustrated in FIG. 5A, the product 2 at the upper level may possibly fall, thus making it difficult to achieve stacking.

FIGS. 3A-1 to 3C-2 are plan views and partially enlarged views illustrating another size-reduction-related problem and a pallet indicating a solution to the problem. In FIGS. 3A-1 to 3C-2, the casters 21 attached to the bottom of the product 2 are also illustrated.

Figures 1, 3A:
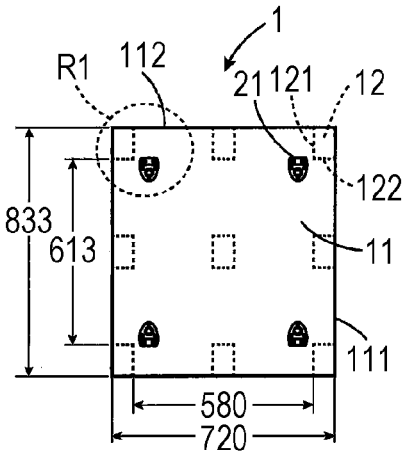
FIGS. 3A-1 to 3C-2 are plan views and partially enlarged views illustrating another size-reduction-related problem and a pallet indicating a solution to the problem.
Figures 1, 3B:
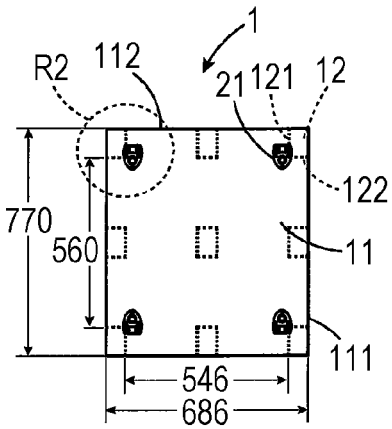
Figures 1, 3C:
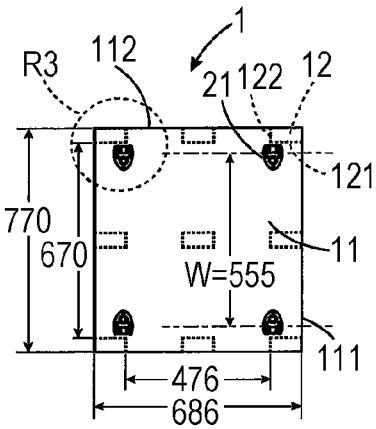
Figures 2, 3A:
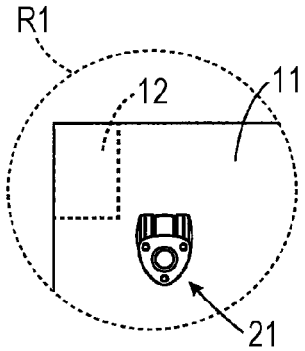
Figures 2, 3B:
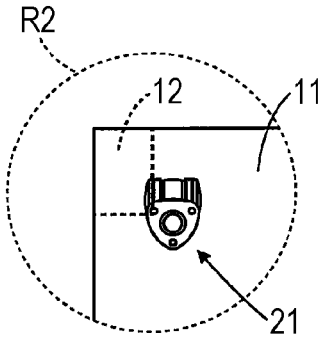
Figures 2, 3C:
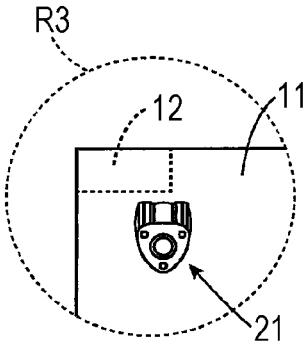

FIG. 3A-1 illustrates the pallet according to the comparative example also illustrated in FIG. 1A, and FIG. 3A-2 is an enlarged view of an area indicated with a circle R1 illustrated in FIG. 3A-1. FIG. 3B-1 illustrates a pallet at an intermediate stage leading to the pallet according to the exemplary embodiment of the disclosure, and FIG. 3B-2 is an enlarged view of an area indicated with a circle R2 illustrated in FIG. 3B-1. FIG. 3C-1 illustrates the pallet according to the exemplary embodiment of the disclosure, and FIG. 3C-2 is an enlarged view of an area indicated with a circle R3 illustrated in FIG. 3C-1.

The top plate 11 of the pallet 1 according to the comparative example illustrated in FIG. 3A-1 has long sides 111 of 833 mm and short sides 112 of 720 mm. The blocks 12 each have a rectangular shape with long sides 121 extending along the long sides 111 of the top plate 11 and short sides 122 extending along the short sides 112 of the top plate 11. It is assumed that the product 2 is transported by inserting a fork of a pallet jack or a forklift (not illustrated but represented by a pallet jack below) under the top plate 11 and lifting the pallet 1. The fork of the pallet jack has a width W of 555 mm, as illustrated in FIG. 3C-1. In the case of the pallet 1 in FIGS. 3A-1 and 3A-2, the blocks 12 at opposite ends of each long side 111 of the top plate 11 are separated by a gap of 613 mm, and the blocks 12 at opposite ends of each short side 112 of the top plate 11 are separated by a gap of 580 mm. Therefore, the fork having the width W of 555 mm of the pallet jack is insertable from either the long sides 111 or the short sides 112. In the case of the comparative example illustrated in FIG. 3A-1, the casters 21 are appropriately positioned away from the blocks 12, as illustrated in FIG. 3A-2.

The pallet 1 illustrated in FIG. 3B-1 is obtained by reducing the size of the pallet 1 in FIG. 3A-1 to match the size of the pallet according to this exemplary embodiment illustrated in FIG. 3C-1. In the pallet 1 illustrated in FIG. 3B-1, the blocks 12 at opposite ends of each long side 111 of the top plate 11 are separated by a gap of 560 mm, and the blocks 12 at opposite ends of each short side 112 of the top plate 11 are separated by a gap of 546 mm. In the case of the pallet 1 illustrated in FIGS. 3B-1 and 3B-2, the fork having the width W of 555 mm of the pallet jack is not insertable from the short sides 112. Although the fork is insertable from the long sides 111 from calculation, it is substantially difficult to insert the fork from the long sides 111 since the clearance is too small. Therefore, in the case of the pallet 1 illustrated in FIGS. 3B-1 and 3B-2 that is simply reduced in size, it is difficult to transport the product 2 placed on the pallet 1 by using the pallet 1.

Furthermore, in the case of the pallet 1 illustrated in FIG. 3B-1, the casters 21 are placed at positions immediately adjacent to the blocks 12, as illustrated in FIG. 3B-2. If neglecting vibration absorbability with respect to the product 2, it is desirable that the casters 21 overlap the blocks 12. However, in this case, absorption of vertical vibrations of the product 2 by utilizing the bending of the top plate 11 is not possible. Moreover, even with the casters 21 being displaced from the blocks 12, if the casters 21 are placed at positions immediately adjacent to the blocks 12, the top plate 11 may possibly be sheared by the edges of the blocks 12.

In the pallet 1 according to this exemplary embodiment illustrated in FIG. 3C-1, the top plate 11 is similar to the pallet 1 in FIG. 3B-1 in that the long sides 111 are 770 mm and the short sides 112 are 686 mm. However, in the case of the pallet 1 illustrated in FIGS. 3C-1 and 3C-2, the blocks 12 are disposed such that the long sides 121 thereof extend along the short sides 112 of the top plate 11. Furthermore, the short sides 122 of each block 12 are dimensionally reduced such that the blocks 12 at opposite ends of each long side 111 of the top plate 11 are separated by a gap of 670 mm. The long sides 121 of each block 12 are dimensionally increased, where appropriate, thereby reducing the possibility of tilting of the blocks 12 and the difficulty of stacking with respect to the direction of the short sides 112, as described above with reference to FIG. 2B. Moreover, in the case of the pallet 1 according to this exemplary embodiment illustrated in FIG. 3C-1, the casters 21 are appropriately positioned away from the blocks 12, as illustrated in FIG. 3C-2.

However, with regard to the pallet 1 illustrated in FIGS. 3C-1 and 3C-2, a fork is not insertable from the short sides 112 of the top plate 11. By allowing a fork to be insertable from the long sides 111 of the top plate 11, both size reduction and transportability of the pallet 1 may be achieved.

Figure 4A:
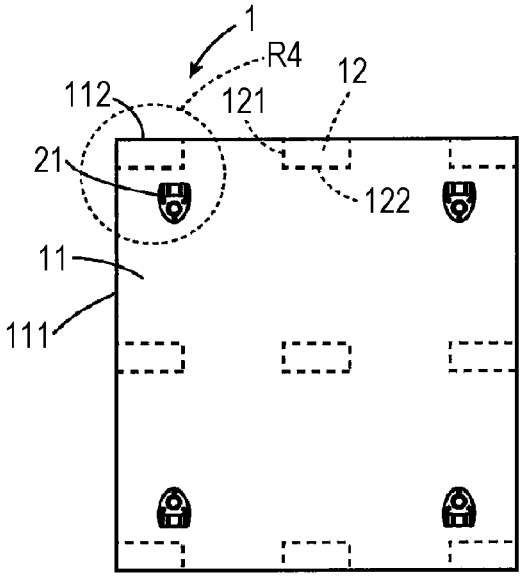
FIGS. 4A to 4C illustrate a pallet according to this exemplary embodiment.
Figure 4B:
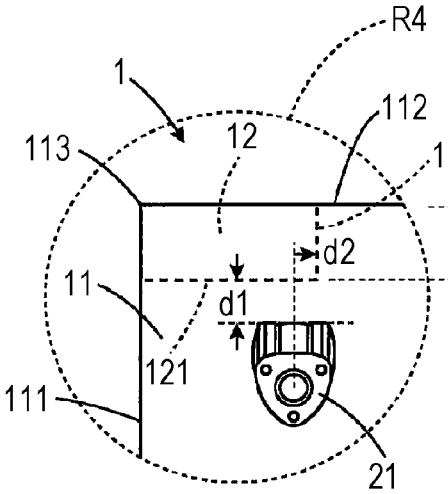
Figure 4C:
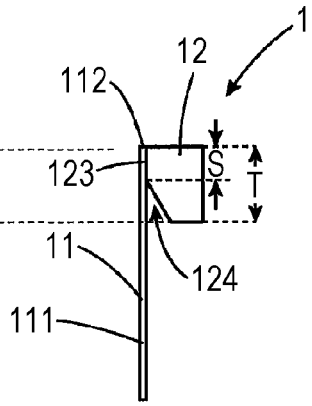

FIGS. 4A to 4C illustrate the pallet 1 according to this exemplary embodiment.

FIG. 4A is a plan view similar to FIG. 3C-1. This plan view is similar to FIG. 3C-1 in that the top plate 11 of the pallet 1 is indicated with a solid line and the blocks 12 are indicated with dashed lines. In FIG. 4A, the casters 21 attached to the bottom of the product 2 (see FIG. 1A) are also illustrated. The product 2 placed on the pallet 1 according to this exemplary embodiment corresponds to an example of a load object according to an exemplary embodiment of the present disclosure, and the casters 21 attached to the four lower corners of the product 2 correspond to an example of supporters according to an exemplary embodiment of the present disclosure.

FIG. 4B is an enlarged view of an area indicated with a circle R4 illustrated in FIG. 4A, and FIG. 4C is a side view of the same area as in FIG. 4B. FIGS. 4B and 4C similarly illustrate the top plate 11 and the blocks 12 of the pallet 1. Moreover, FIG. 4B similarly illustrates the casters 21 attached to the bottom of the product 2.

The product 2 loaded on the top plate 11 is equipped with the casters 21 that are provided at the four lower corners of the product 2 and that support the product 2. Each block 12 disposed at the corresponding corner of the top plate 11 of the pallet 1 is positioned away from the corresponding caster 21 closest to the corner toward the corresponding short side 112 of the top plate 11.

Specifically, each block 12 is positioned away from the corresponding caster 21 by a distance d1 toward the corresponding short side 112. Accordingly, the pallet 1 allows the casters 21 to be placed on the top plate 11 at positions not overlapping the blocks 12, and utilizes the bending of the top plate 11 to absorb vertical vibrations of the product 2 loaded on the pallet 1.

Each block 12 disposed at the corresponding corner of the top plate 11 of the pallet 1 extends along the corresponding short side 112 of the top plate 11 to a position located away from the corner relative to the corresponding caster 21, of the product 2 loaded on the top plate 11, closest to the corner. Specifically, in the extending direction of the short sides 112 of the top plate 11, each block 12 extends from a corresponding corner 113 of the top plate 11 to a position located away from the corresponding caster 21 by a distance d2. In this exemplary embodiment, the blocks 12 extend along the short sides 112 to satisfy this condition, thereby allowing a fork to be insertable as well as reducing the possibility of tilting of the blocks 12 and the difficulty of stacking.

Furthermore, in the case of the pallet 1 according to this exemplary embodiment, as illustrated in FIG. 4C, at least the blocks 12 disposed at the corners of the top plate 11 are each cut out at the side located away from the corresponding short side 112 of the top plate 11 such that a width S by which an upper surface 123 of the block 12 is in contact with the top plate 11 along the corresponding long side 111 of the top plate 11 is smaller than an overall width T of the block 12. In the example illustrated in FIG. 4C, the block 12 has a cutout 124 having a tapered shape.

Accordingly, the casters 21 are appropriately disposed further away from where the blocks 12 are in contact with the top plate 11, as compared with a case where the cutouts 124 are not provided, thereby utilizing the bending of the top plate 11 more effectively to absorb a transit impact. However, if the casters 21 are disposed too far from where the blocks 12 are in contact with the top plate 11, the top plate 11 may bend too much and possibly break. Thus, it is desirable that the dimensions of the top plate 11 and the blocks 12 be set such that the casters 21 are appropriately positioned away from where the blocks 12 are in contact with the top plate 11, that is, where tilting may be prevented and stacking may be improved, and are disposed where the top plate 11 is prevented from breaking due to shearing and bending of the top plate 11.

Figure 5B:
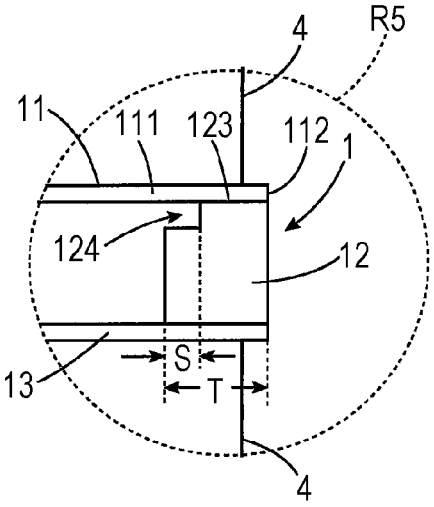

FIG. 5A and FIG. 5B are a front view and a partially enlarged view, respectively, illustrating two stacked pallets 1 loaded with products, as viewed from one of the long sides 111 of the top plate 11. FIG. 5B is an enlarged view of an area indicated with a circle R5 illustrated in FIG. 5A. Each of the blocks 12 illustrated in FIGS. 5A and 5B is cut out at the side located away from the corresponding short side 112 of the top plate 11 such that the width S by which the upper surface 123 of the block 12 is in contact with the top plate 11 along the corresponding long side 111 of the top plate 11 is smaller than the overall width T of the block 12. In the example illustrated in FIGS. 5A and 5B, the block 12 has a cutout 124 recessed in a step-like shape. Accordingly, the shape of the cutout 124 is not particularly limited so long as the width S in contact with the top plate 11 is smaller than the overall width T.

By providing the cutouts 124 at the side in contact with the top plate 11 in this manner, vertical vibrations may be absorbed. On the other hand, the blocks 12 are in contact with the bottom plate 13 over the overall width T, thereby reducing the possibility of tilting of the blocks 12 and the difficulty of stacking.

Figure 6A:
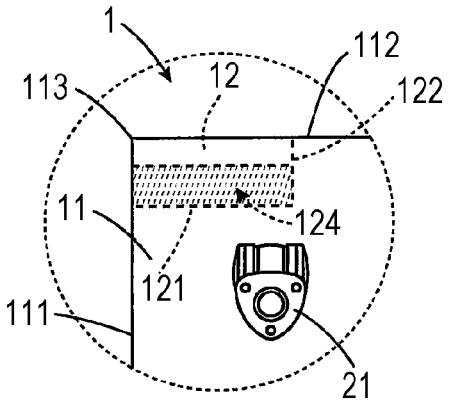
FIGS. 6A and 6B each illustrate a region including a cutout of a block.
Figure 6B:
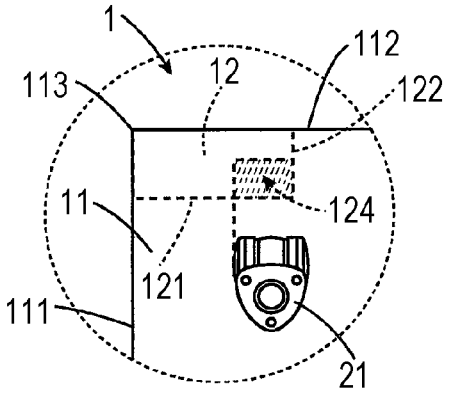

FIGS. 6A and 6B each illustrate a region including the cutout 124 of each block 12. Specifically, FIG. 6A is a partially enlarged view corresponding to FIG. 4B according to the above exemplary embodiment, and FIG. 6B is a partially enlarged view illustrating a modification of the above exemplary embodiment.

The cutout 124 illustrated in FIG. 6A extends along the entire length of the block 12 in the longitudinal direction thereof (i.e., along the short side 112 of the top plate 11). In contrast, the cutout 124 illustrated in FIG. 6B is provided in a part of the block 12 including an area overlapping the corresponding caster 21 in the longitudinal direction of the block 12 (i.e., along the short side 112 of the top plate 11). As an alternative to FIG. 6A in which the cutout 124 extends along the entire length, the cutout 124 may be partially provided in a specific area, such as in an area overlapping the corresponding caster 21, as illustrated in FIG. 6B. This configuration is still effective for appropriately disposing the casters 21 away from where the blocks 12 are in contact with the top plate 11.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A pallet comprising:

a top plate that has a rectangular shape;

a plurality of blocks that are disposed at a plurality of locations including four corners of the top plate and that support the top plate from below; and a bottom plate that is disposed such that the plurality of blocks are placed on the bottom plate, wherein the top plate has a long side and a short side, wherein blocks included in the plurality of blocks and disposed at the corners of the top plate each has a long side and a short side, and wherein the long side of each of the blocks included in the plurality of blocks and disposed at the corners of the top plate is disposed along the short side of the top plate, wherein each of the blocks included in the plurality of blocks and disposed at the corners of the top plate has a cutout shape at a side located away from the short side of the top plate such that a width by which an upper surface of the block is in contact with the top plate along the long side of the top plate decreases.

2. The pallet according to claim 1, wherein two of the blocks disposed at opposite ends of the top plate in a direction of the long side are separated by a distance that allows a fork of a forklift or a pallet jack to be insertable between the two blocks.

3. The pallet according to claim 2, wherein two of the blocks disposed at opposite ends of the top plate in a direction of the short side are separated by a distance small to an extent that the fork of the forklift or the pallet jack is not insertable between the two blocks.

4. The pallet according to claim 1, wherein two of the blocks disposed at opposite ends of the top plate in a direction of the long side are separated by a distance that allows a fork of a forklift or a pallet jack to be insertable between the two blocks.

5. The pallet according to claim 4, wherein two of the blocks disposed at opposite ends of the top plate in a direction of the short side are separated by a distance small to an extent that the fork of the forklift or the pallet jack is not insertable between the two blocks.

6. A product, comprising:

a load object; and a pallet comprising:

a top plate that has a rectangular shape and that is to be loaded with the load object;

a plurality of blocks that are disposed at a plurality of locations including four corners of the top plate and that support the top plate from below; and a bottom plate that is disposed such that the plurality of blocks are placed on the bottom plate, wherein the top plate has a long side and a short side, wherein blocks included in the plurality of blocks and disposed at the corners of the top plate each has a long side and a short side, and wherein the long side of each of the blocks included in the plurality of blocks and disposed at the corners of the top plate is disposed along the short side of the top plate, wherein each of the blocks included in the plurality of blocks and disposed at the corners of the top plate has a cutout shape at a side located away from the short side of the top plate such that a width by which an upper surface of the block is in contact with the top plate along the long side of the top plate decreases.

7. The product of claim 6, wherein the load object to be loaded on the top plate includes supporters that are provided at four lower corners of the load object and that support the load object, and each block disposed at the corresponding corner of the top plate is positioned away from the corresponding supporter toward the short side of the top plate, the supporter being included in the load object loaded on the top plate and being closest to the corner.

8. The product of claim 7, wherein each block disposed at the corresponding corner of the top plate extends along the short side of the top plate to a position located away from the corner relative to the corresponding supporter, of the load object loaded on the top plate, closest to the corner.

* * * * *